US011431128B2

(12) United States Patent
Liu et al.

(10) Patent No.: US 11,431,128 B2
(45) **Date of Patent: *Aug. 30, 2022**

(54) ELECTRICAL CONNECTOR ASSEMBLY

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Meng Liu, Kunshan (CN); Shih-Wei Hsiao, New Taipei (TW); Yu-San Hsiao, New Taipei (TW); Yen-Chih Chang, New Taipei (TW); Yu-Ke Chen, Kunshan (CN); Jhih-Yao Jiang, New Taipei (TW)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 17/137,404

(22) Filed: Dec. 30, 2020

(65) Prior Publication Data

US 2021/0203108 A1 Jul. 1, 2021

(30) Foreign Application Priority Data

Dec. 31, 2019 (CN) ..... 201911407326.5

(51) Int. Cl.
*H01R 4/66* (2006.01)
*H01R 13/6471* (2011.01)
(Continued)

(52) U.S. Cl.
CPC ..... *H01R 13/6471* (2013.01); *H01R 12/55* (2013.01); *H01R 12/716* (2013.01);
(Continued)

(58) Field of Classification Search
CPC ..... H01R 13/6461; H01R 13/6471; H01R 13/2407; H01R 13/514; H01R 13/6587; H01R 12/55; H01R 12/716
(Continued)

(56) References Cited

U.S. PATENT DOCUMENTS 6,899,566 B2 5/2005 Kline et al.
6,988,902 B2 1/2006 Winings et al.
(Continued)

FOREIGN PATENT DOCUMENTS

CN 202034538 11/2011
CN 202454772 9/2012
(Continued)

*Primary Examiner* — Khiem M Nguyen
(74) *Attorney, Agent, or Firm* — Ming Chieh Chang; Wei Te Chung

(57) ABSTRACT

An electrical connector includes: an insulating housing; plural terminals held on the insulating housing, the terminals are arranged in terminal pairs for transmitting differential signals; and plural shielding sheets held on the insulating housing, each of the shielding sheets includes: at least two walls shielding the terminal pair in at least two directions, and plural elastic pieces extending from the at least two walls in order to cooperate with a mating connector; wherein the elastic pieces of each shielding sheet include an inner elastic piece protruding toward an associated terminal pair and an outer elastic piece protruding away from the associated terminals pair.

18 Claims, 10 Drawing Sheets

(51) Int. Cl.

| | |
|---|---|
| ***H01R 13/6587*** | (2011.01) |
| ***H01R 13/24*** | (2006.01) |
| ***H01R 12/55*** | (2011.01) |
| ***H01R 13/514*** | (2006.01) |
| ***H01R 12/71*** | (2011.01) |

(52) U.S. Cl.
CPC ..... *H01R 13/2407* (2013.01); *H01R 13/514* (2013.01); *H01R 13/6587* (2013.01)

(58) Field of Classification Search
USPC ..... 439/92, 108
See application file for complete search history.

(56) References Cited

U.S. PATENT DOCUMENTS

| | | | |
|---|---|---|---|
| 7,785,148 | B2 | 8/2010 | Pan |
| 8,202,118 | B2 | 6/2012 | Cohen et al. |
| 8,465,302 | B2 | 6/2013 | Regnier et al. |
| 8,715,005 | B2 | 5/2014 | Pan |
| 8,905,786 | B2 | 12/2014 | Davis et al. |
| 8,920,195 | B2 | 12/2014 | Cohen et al. |
| 8,961,227 | B2 | 2/2015 | Gailus et al. |
| 8,961,229 | B2 | 2/2015 | Pan |
| 9,077,094 | B2 | 7/2015 | Minich |
| 9,356,401 | B1 | 5/2016 | Horning et al. |
| 9,407,045 | B2 | 8/2016 | Horning et al. |
| 9,748,698 | B1 | 8/2017 | Morgan et al. |
| 9,831,588 | B2 | 11/2017 | Cohen |
| 10,038,282 | B2 | 7/2018 | De Geest et al. |
| 10,170,869 | B2 | 1/2019 | Gailus et al. |
| 10,205,286 | B2 | 2/2019 | Provencher et al. |
| 10,355,416 | B1 | 7/2019 | Pickel et al. |
| 10,644,453 | B2 | 5/2020 | Laurx et al. |
| 10,686,282 | B1 | 6/2020 | McCarthy et al. |
| 10,707,626 | B2 | 7/2020 | Cartier, Jr. et al. |

FOREIGN PATENT DOCUMENTS

| | | |
|---|---|---|
| CN | 204668627 | 9/2015 |
| CN | 102904119 | 6/2016 |
| CN | 104167620 | 8/2017 |
| CN | 104718666 | 8/2018 |
| CN | 109494499 | 3/2019 |
| CN | 105470736 | 8/2019 |

ELECTRICAL CONNECTOR ASSEMBLY

BACKGROUND OF THE INVENTION

1. Field of the Invention

The present invention relates generally to an electric connector assembly with an electric connector, and more particularly to a high-speed backplane electrical connector assembly used in the communication field.

2. Description of Related Arts

U.S. Pat. No. 6,988,902 discloses an electrical connector assembly with a plug electrical connector and receptacle electrical connector matched with the plug electrical connector. Both the plug electrical connector and receptacle electrical connector include plurality rows of terminals. The terminals of each row include a differential signal pair and a ground terminal arranged between adjacent differential signal pairs. Each differential signal pair in each column is staggered from the corresponding differential signal pair in the adjacent column. There is no metal shield between adjacent rows. Although the misalignment of the differential pair can reduce crosstalk to a certain extent, can realize the transmission of lower differential signals of 6 Gbps and below, however, with the increase in the transmission speed of differential signals, the transmission speed of many differential signals has reached 25 Gbps or even higher reaches 56 Gbps at present. Therefore, it is difficult to satisfy the transmission of high-speed signals by simply relying on this staggered arrangement. Therefore, an improved electrical connector assembly is needed.

An improved electrical connector assembly with an electrical connector and is desired, that can transmit differential signal transmission at 56 Gbps or higher.

SUMMARY OF THE INVENTION

A main object of the present invention is to provide an electrical connector and electrical connector assembly that optimizes the ground connection effect, thereby improving signal transmission.

To achieve the above-mentioned object, an electrical connector comprises: an insulating housing; a plurality of terminals held on the insulating housing, the terminals are arranged in terminal pairs for transmitting differential signals; and a plurality of shielding sheets held on the insulating housing, each of the shielding sheets includes: at least two walls shielding the terminal pair in at least two directions, and a plurality of elastic pieces extending from the at least two walls in order to cooperate with a mating connector; wherein the elastic pieces of each shielding sheet include an inner elastic piece protruding toward an associated terminal pair and an outer elastic piece protruding away from the associated terminals pair.

To achieve the above-mentioned object, an electrical connector assembly comprises: a first electrical connector; and a second electrical connector mated with the first connector; the second electrical connector comprising: an insulating housing; a plurality of terminals held on the insulating housing, the terminals are arranged in terminal pairs for transmitting differential signals, the terminal pairs are arranged in rows and columns; and a plurality of shielding sheets held on the insulating housing, each of the shielding sheets including: at least two walls shielding the terminal pair in at least two directions, and a plurality of elastic pieces extending from the at least two walls; wherein the elastic pieces of each shielding sheet includes an inner elastic piece protruding toward a pair of the terminals forming the terminal pair and an outer elastic piece protruding away from the same pair of terminals.

Compared to the prior art, in the electrical connector of the present invention, the elastic piece of the present invention includes an inner elastic piece protruding toward the terminal pair and an outer elastic piece protruding away from the terminal pair, thereby optimizing the ground connection effect and improving the electrical connector and Electrical connector assembly signal transmission.

DETAILED DESCRIPTION OF THE PREFERRED EMBODIMENT

Figure 1:
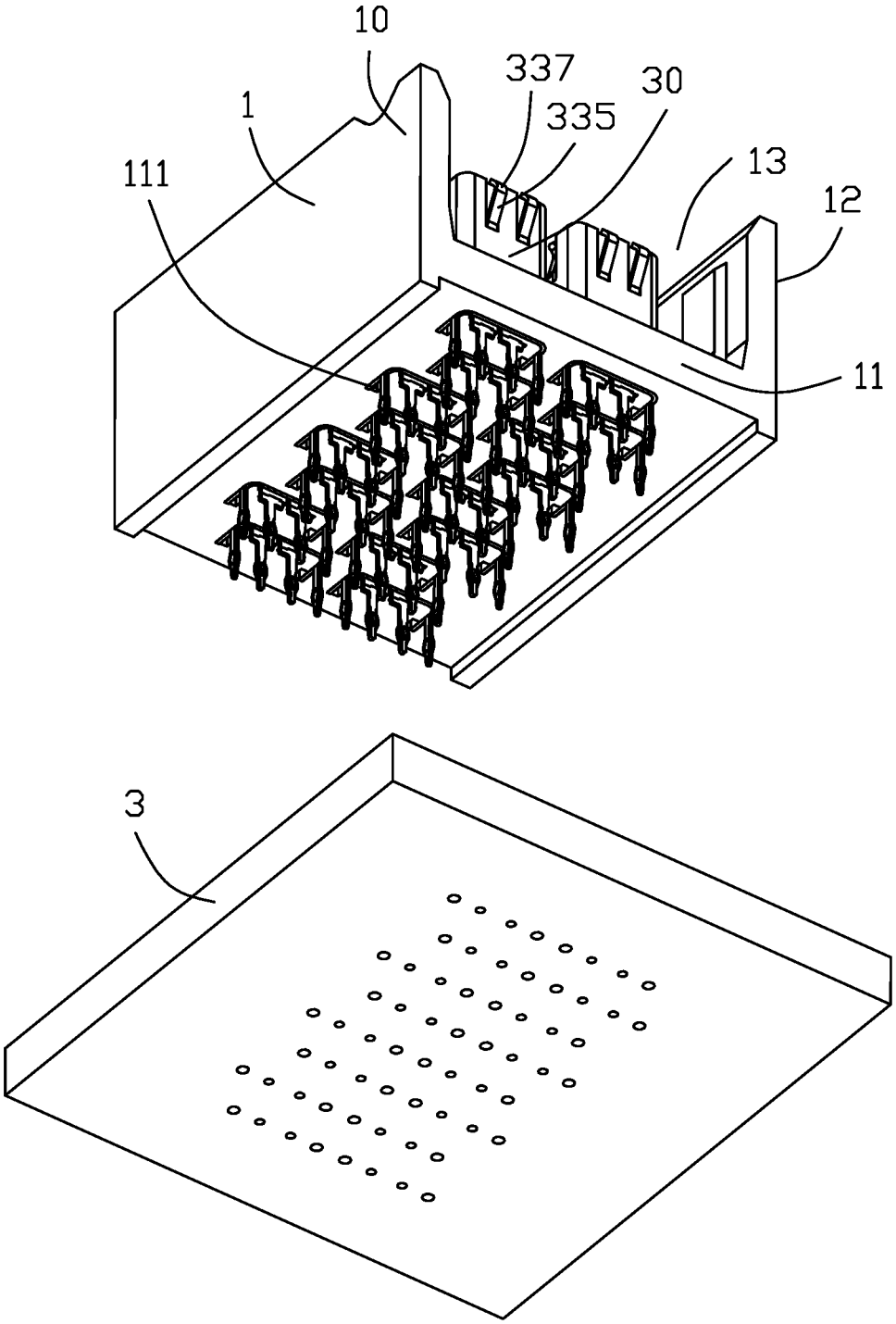
FIG. 1 is a perspective view of an electrical connector in accordance with the present invention and a printed circuit board to which the electrical connector is mounted.
Figure 2:
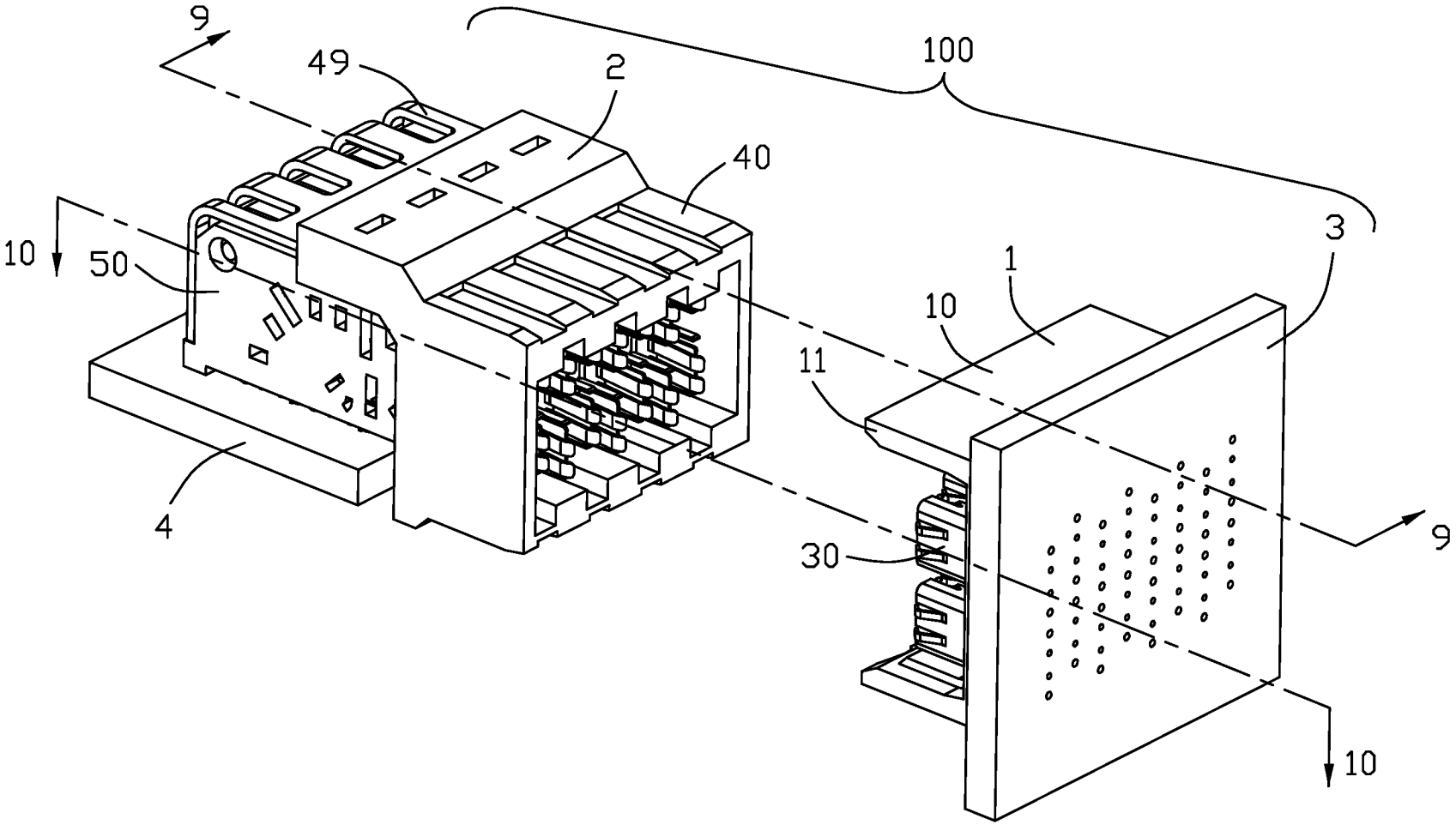
FIG. 2 is a perspective view the electrical connector assembly before mating.
Figure 3:
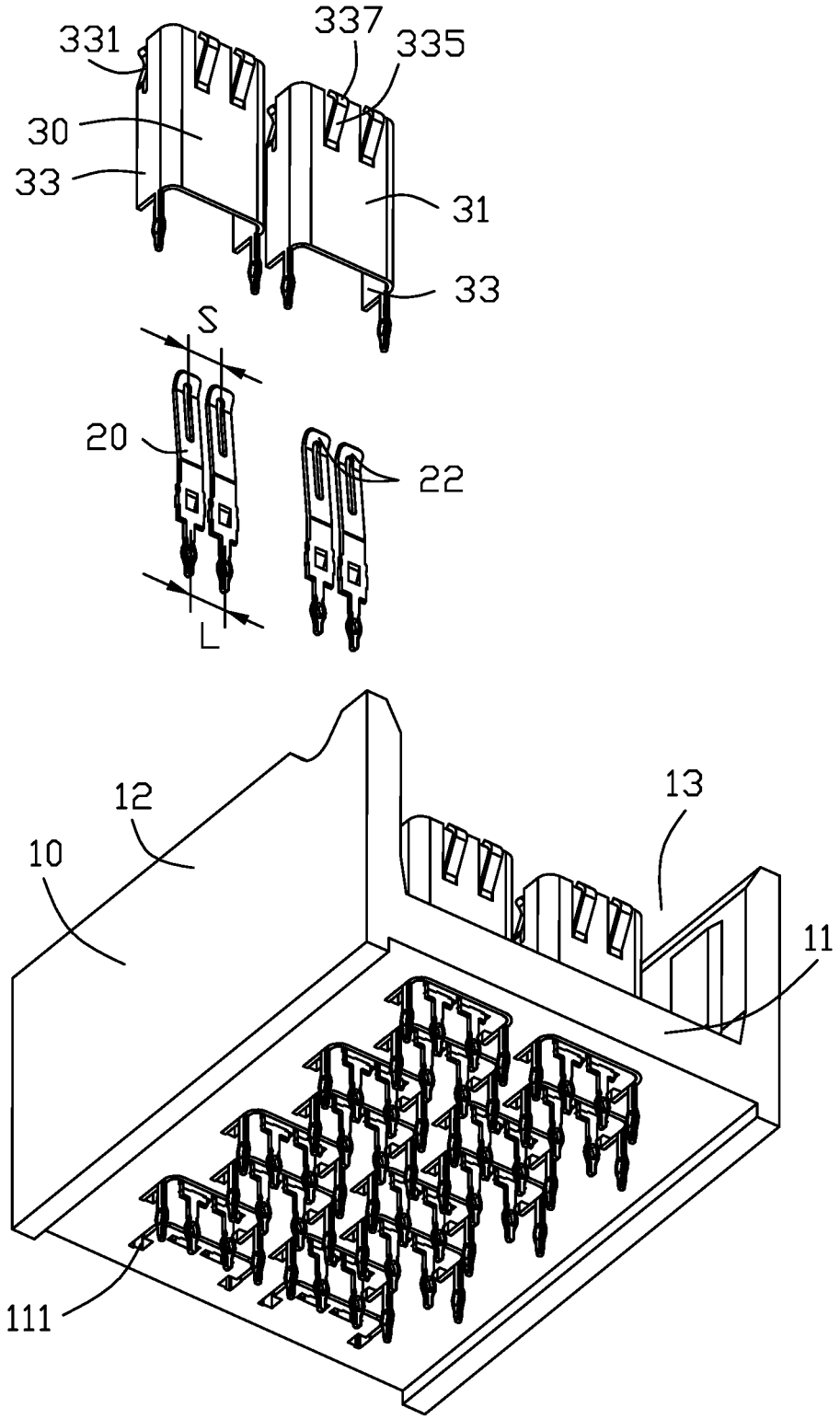
FIG. 3 is a partial exploded view of the electrical connector in FIG. 1.
Figure 4:
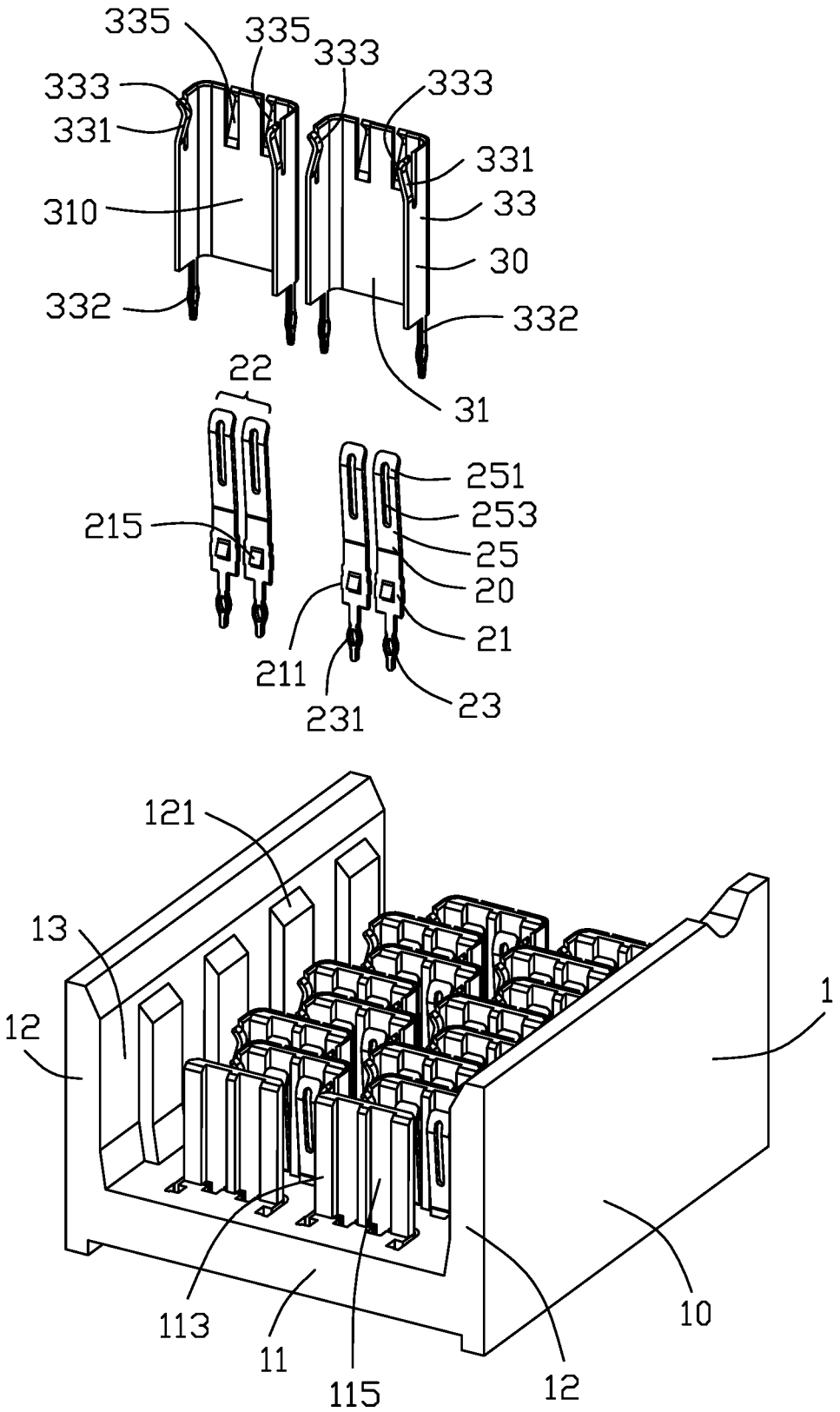
FIG. 4 is another partial exploded view of the electrical connector in FIG. 3.
Figure 5:
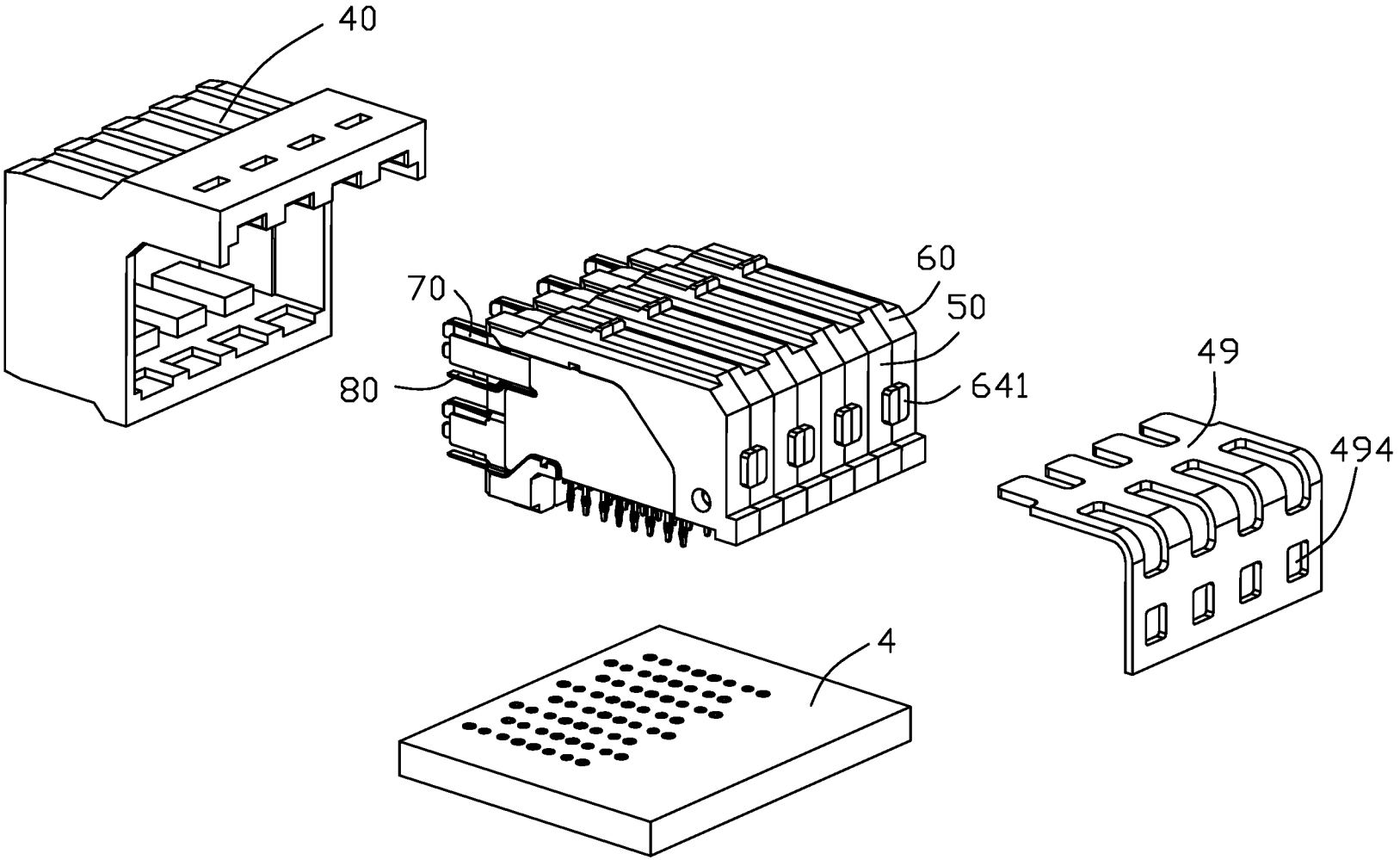
FIG. 5 is a partial exploded view of the mating electrical connector in FIG. 2.
Figure 6:
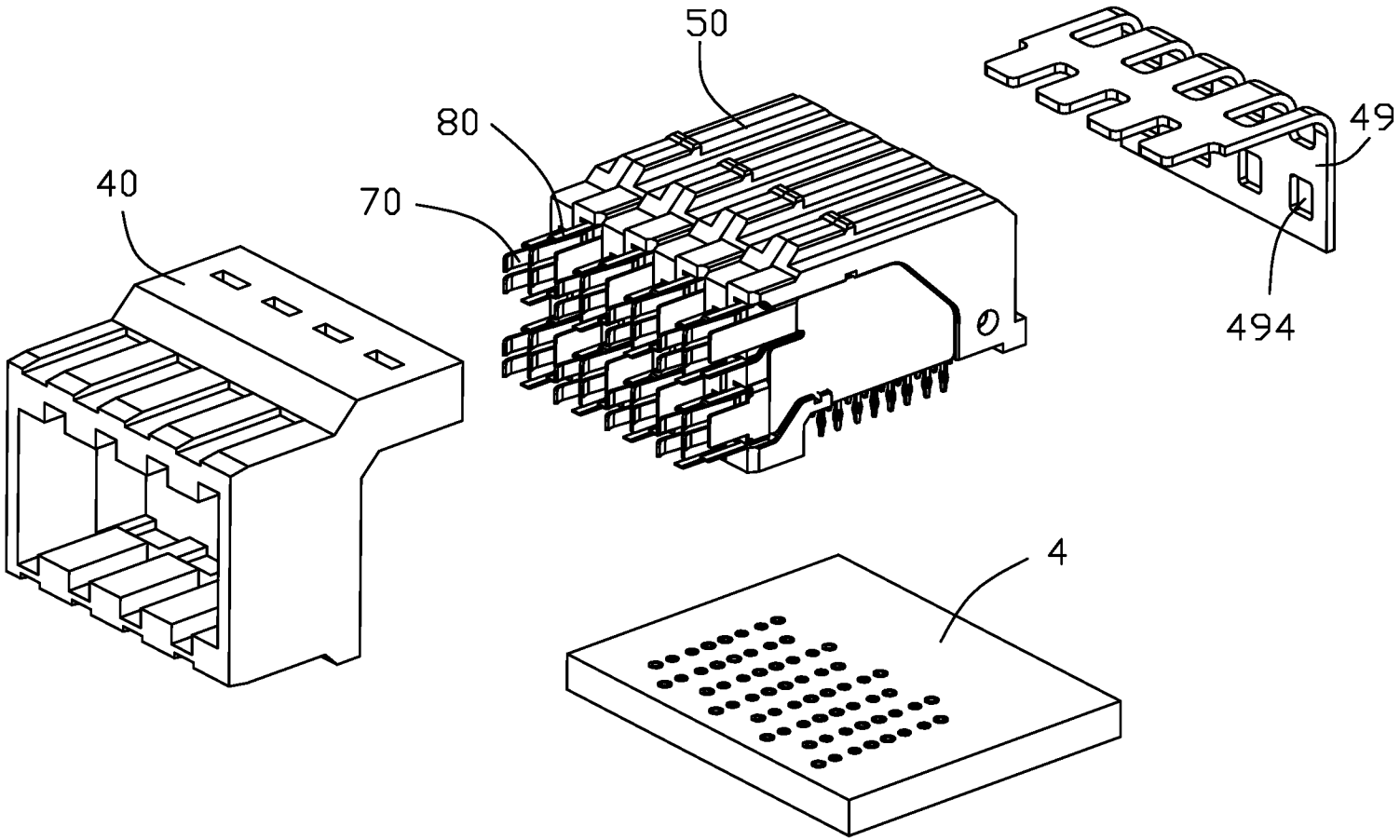
FIG. 6 is another partial exploded view of the mating electrical connector in FIG. 5.
Figure 7:
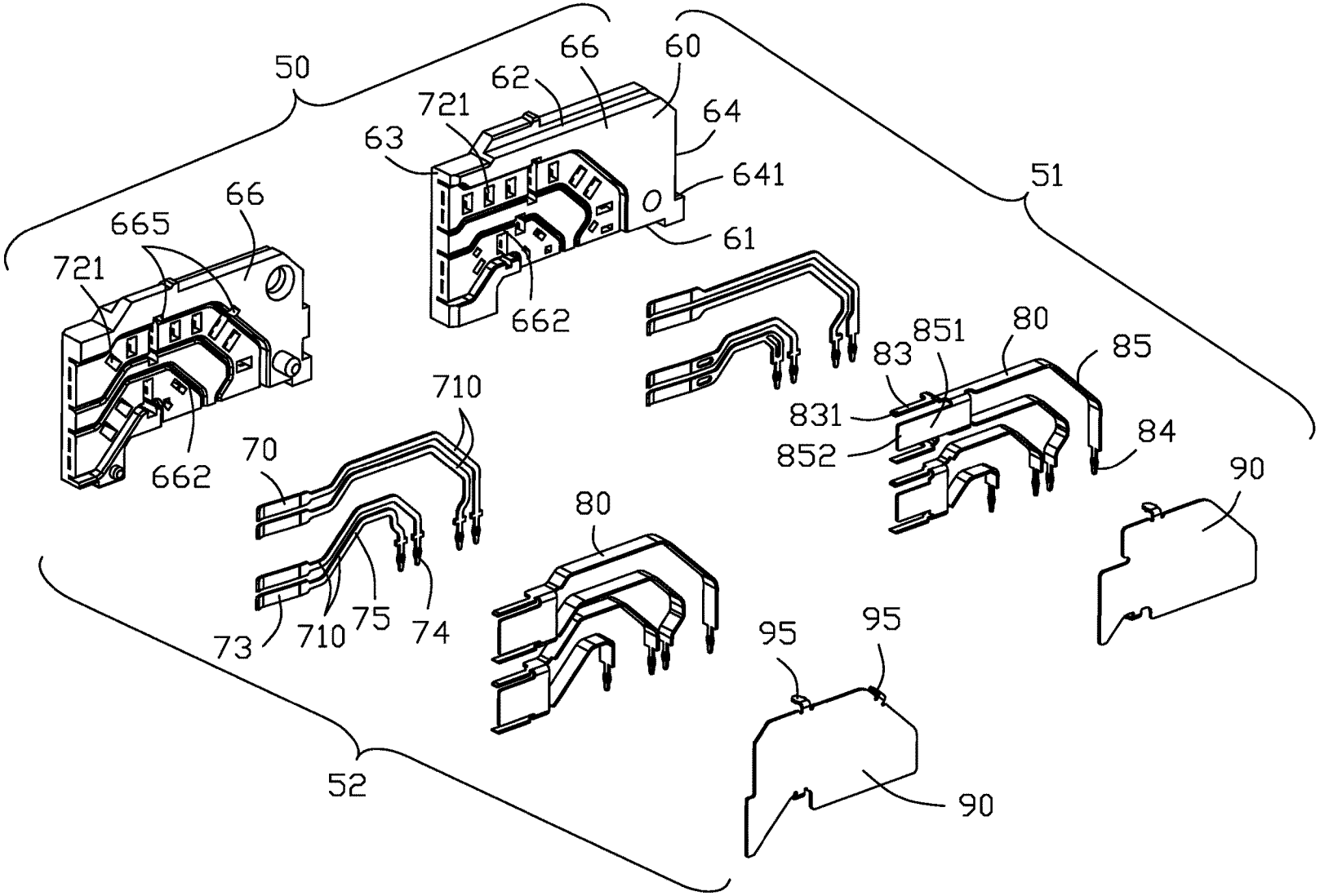
FIG. 7 is a perspective view of a pair of adjacent terminal modules in FIG. 5.
Figure 8:
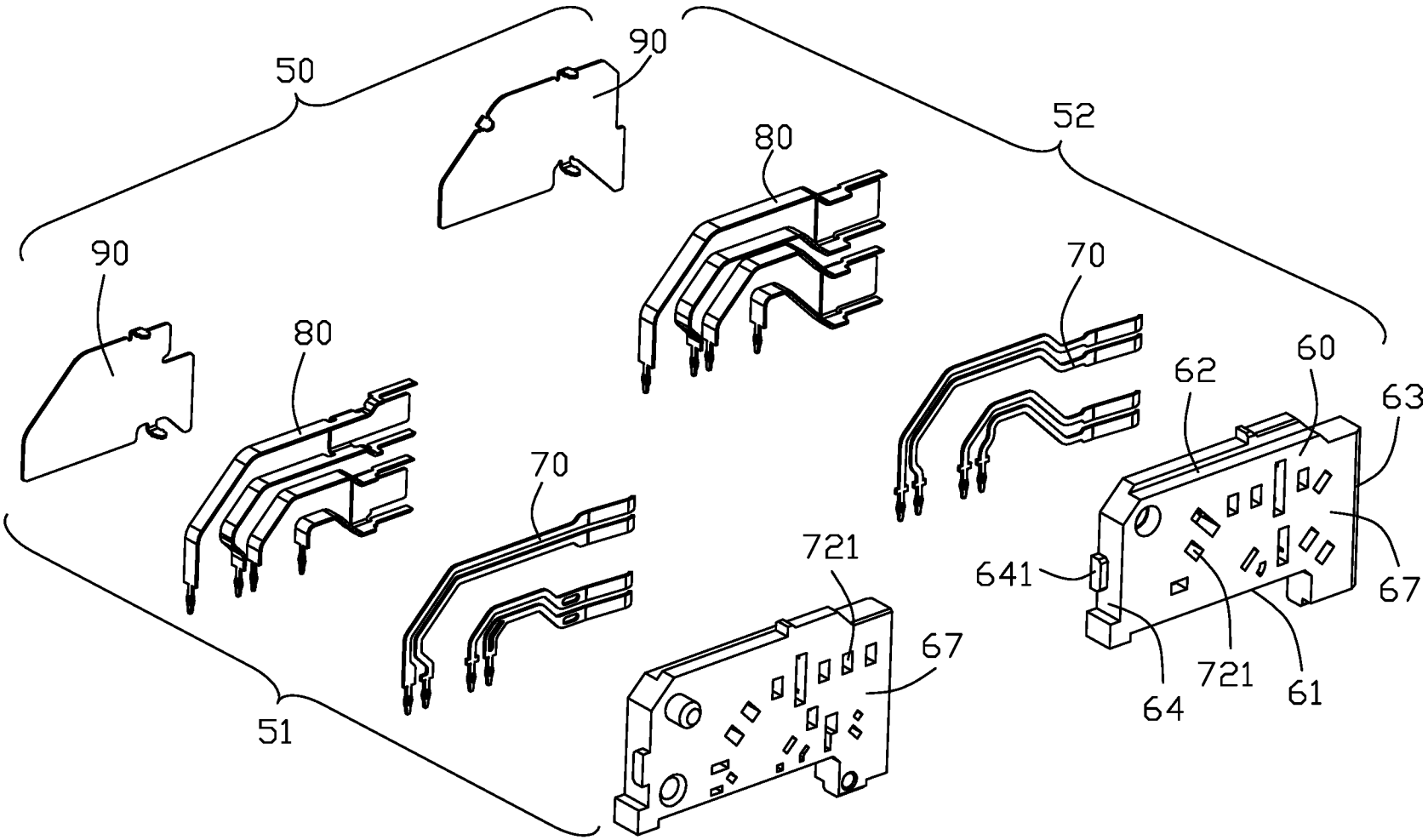
FIG. 8 is another perspective view of a pair of adjacent terminal modules in FIG. 7.
Figure 9:
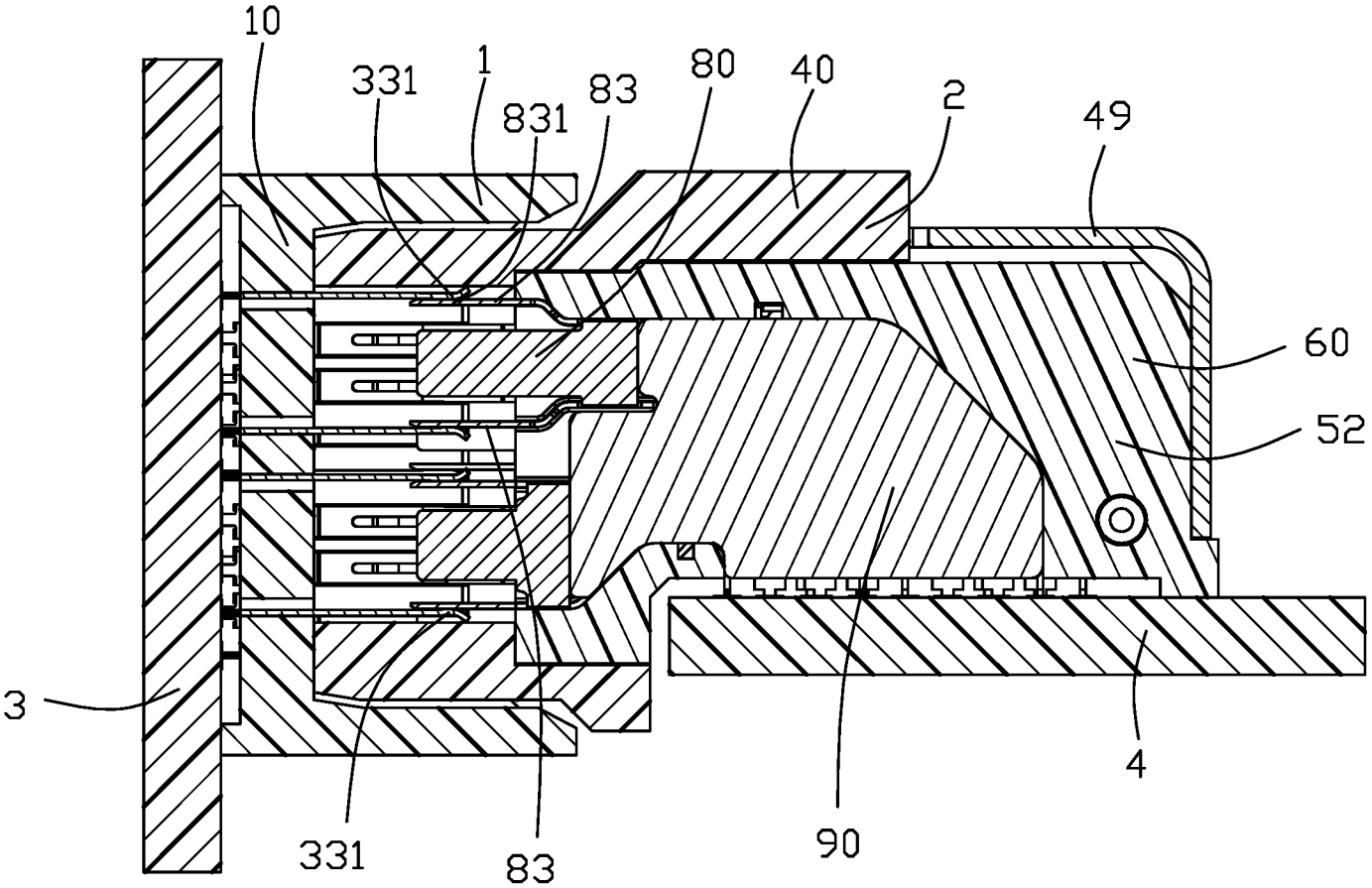
FIG. 9 is a cross-sectional view along line 9-9 of the electrical connector assembly after mating in FIG. 2.
Figure 10:
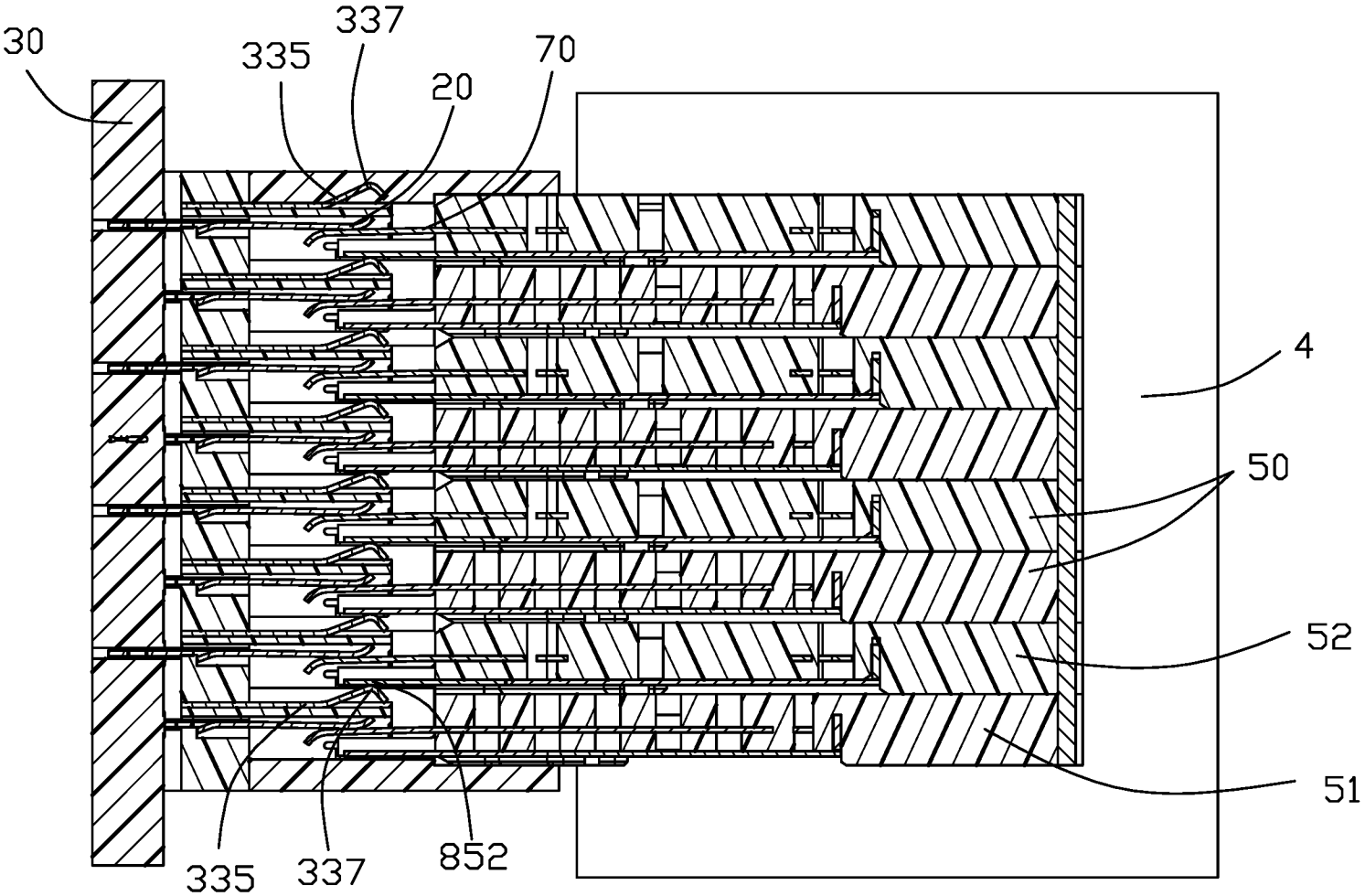
FIG. 10 is a cross-sectional view along line 10-10 of the electrical assembly after mating in FIG. 2.

Referring to FIGS. 1-10, an electrical connector assembly 100 of the present invention includes an electrical (header) connector or a first electrical connector 1 and a mating (receptacle) connector or a second electrical connector 2 that cooperates with the first electrical connector 1. The first electrical connector 1 is mounted on the circuit board or the first circuit board 3, and the second electrical connector 2 is mounted on the mating circuit board or the second circuit board 4. After the first electrical connector 1 and the second electrical connector 2 are mated, the transmission speed per channel can reach 112 Gbps or even higher.

Referring to FIGS. 1-4 and 9-10, the first electrical connector 1 includes an insulating housing 10, a plurality of terminals 20 fixed on the insulating housing 10, and a shielding sheet 30 fixed in the insulating housing 10 to shield the terminals 20. The terminals 20 are arranged in differential pairs, and each differential pair transmits a pair of differential signals.

The insulating housing 10 includes a bottom wall 11, a pair of side walls 12 spaced apart from each other extending from the same side of the bottom wall 11. The bottom wall 11 and the two side walls 12 are jointly enclosed to form a receiving space 13. The bottom wall 11 includes a plurality of mounting holes 111 that penetrate the bottom wall 11 in rows and columns, and the mounting holes 111 are used for mounting the terminals 20 and the shielding sheet 30. The bottom wall 11 is provided with a plurality of supporting walls 113 protruding toward the receiving space 13 for supporting the terminals 20, and each supporting wall 113 includes two grooves 115. The side wall 12 is provided with a guiding protrusion 121 that guides the second electrical connector 2 to be accurately inserted into the receiving space 13.

Each of the terminals 20 includes a holding portion 21 for holding on the bottom wall 11, a mounting portion 23 extending downward from the holding portion 21, and the mounting portion 23 is used for mounting on the first circuit board 3, a cantilever 25 extending upward from the holding portion 21 into the receiving space 13, and a contact portion 251 located at the front of the cantilever 25. A slot 253 is provided on the cantilever 25, and the slot 253 extends to the contact portion 251. The periphery of the slot 253 is completely enclosed in the terminal 20. The cantilever 25 is received in the grooves 115. By providing a slot 253 extending to the contact portion 251 on the terminal 20, by providing a slot 253 extending to the contact portion 251 on the terminal 20, the contact area of the terminal 20 is reduced, thereby reducing the capacitance effect, therefore, the impedance matching on the entire transmission path is improved, and the shielding effect of the electrical connector 1 is improved. The terminal 20 is formed by stamped from a flat metal plate and then bended, each of the terminals 20 includes a wide side on the surface of the flat metal plate and a narrow side cut from the flat plate material. There are barbs 211 protruding outwardly on the narrow sides of both sides of the holding portion 21. The wide side is provided with wide barbs 215 protruding from the wide side, and the wide barbs 215 are torn out from the wide side to form. Each of the terminal 20 is installed in the mounting hole 111 on the bottom wall 11 and fixed on the bottom wall 11 by barbs 211 and wide barbs 215. Two adjacent terminals 20 form a terminal pair 22 for transmitting a pair of differential signals. The two terminals 20 forming the terminal pair 22 are all narrow-side coupled from the mounting portion 23 to the contact portion 251. The distance from the center of the contact portion 251 of one terminal 20 of the terminal pair 22 to the center of the contact portion 251 of the other terminal 20 is the first dimension S, and the distance from the center of the mounting portion 23 to the center of the mounting portion 23 of the other terminal 20 is the second dimension L. The first dimension S is smaller than the second dimension L to reduce signal crosstalk between the terminal pair 22 and the adjacent terminal pair 22.

The shielding sheet 30 includes a main wall 31 and a pair of side walls 33 extending from both sides of the main wall in the same direction. The main wall 31 and the two side walls 33 surround one terminal pair 22 in three directions, and shield the terminal pair 22 from the other terminal pairs 22. The main wall 31 is parallel to the wide side of the terminal pair 22 it shields, a pair of the side walls 33 are respectively face to the corresponding narrow sides of the terminal pair 22. A plurality of inward elastic pieces 331 extend from the main wall 31 and the side wall 33. In this embodiment, the side of the shielding sheet 30 facing the terminal pair surrounded by it is defined as inner side, the side opposite to the inside is defined as outside. Each side wall 33 includes one elastic piece 331, each elastic piece 331 includes a contact protrusion 333, the elastic piece 331 extends inwardly, and the contact protrusion 333 protrudes inwardly, that is, the elastic piece 331 is an inner elastic piece projecting toward the terminal pair 22. The main wall 31 includes a pair of outward elastic piece 335. The elastic piece 335 includes a contact protrusion 337, the outward elastic piece 335 extends outward, and the contact protrusion 337 protrudes outward. That is, the elastic piece 335 is the external elastic piece that protrudes away from the terminal pair 22. The terminal pair 22 and the corresponding shielding sheet 30 are integrally formed and then fixed to the insulating housing 10 together. The terminal pair 22 and the corresponding shielding sheet 30 are fixed to the insulating housing 10 respectively.

Referring to FIGS. 5-10, the second electrical connector 2 includes a housing 40, a plurality of terminal modules 50 installed in the housing 40 and aligned laterally, a holder 49 for fixing the terminal module 50. Each of the terminal modules 50 includes an insulating body 60, a plurality of signal terminals 70 held in the insulating body 60, a plurality of ground terminals 80 held in the insulating body 60, and a ground plate 90 on one side of the terminal module 50.

The insulating body 60 is sheet-shaped and includes a lower edge 61 facing the mounting direction and an upper edge 62 opposite to the lower edge 61, the front edge 63 facing the mating electrical connector and the rear edge 64 opposite to the front edge 63. The rear edge 64 is provided with a retaining rib 641. The holder 49 includes a clamping hole 494 for receiving a corresponding retaining rib 641. Therefore, each terminal module 50 is fixed by the holder 49 and the housing 40 and aligned laterally. The insulating body 60 has a first side 66 and a second side 67 arranged in the thickness direction thereof. A number of installation slots 662 are provided on the first side 66. The outer surface of the insulating body 60 is coated with a layer of absorbing material.

The signal terminal 70 is integrally formed with the insulating body 60, the signal terminal 70 is arranged in the form of a signal terminal pair 710, and each signal terminal pair 710 is used to transmit a pair of differential signals. Each of the signal terminals 70 includes a mating end 73 extending from the insulating body 60 along the mating direction, and a mounting end 74 extending from the insulating body 60 along the mounting direction and capable of being mounted on the second circuit board 4, and a middle portion 75 between the mounting end 74 and the mating end 73. The mating end 73 is perpendicular to the mounting end 74. Each of the signal terminals 70 includes a wide side and a narrow side. The wide sides of the signal terminal pair 710 are arranged on the same plane. The two signal terminal 70 forming a signal terminal pair 710 are narrow-side coupled from the mounting end 74 to the mating end 73. The insulating body 60 is provided with an air gap 721 for exposing the signal terminal 70 to the air. The air gap 721 can be provided only on one side of the insulating body 60, or can be provided on both sides of the insulating body 60. The purpose is to set the signal terminal 70 in two different materials: air and insulating body 60, and adjust the capacitance effect through the dielectric constant of different materials, in order to improve its characteristic impedance to meet 80-100 ohm. It is also possible to inject a material with a dielectric constant different from that of the insulating body 60 at the opening position to adjust the capacitance effect, or to adjust the capacitance effect by planting electronic components.

The ground terminal 80 includes a ground mating end 83 that cooperates with the first electrical connector 1, a ground mounting end 84 mounted on the second circuit board, and the transition portion 85 between the ground mounting end 84 and the ground mating end 83. The ground mating end 83 includes a pair of first ground contact portions 831 arranged at intervals in the up and down direction. Each ground terminal 80 is installed in a corresponding installation slot 662 on the insulating body 60. In the vertical direction, ground terminals 80 are provided on both sides of each of the differential signal terminal pairs 710. The connection between the ground mating end 83 and the transition portion 85 is provided with a connecting member 851 that connects the ground terminals 80 on both sides of a signal terminal pair 710 together. The ground terminal 80 includes a second ground contact portion 852 extending forward from the connecting member 851. The two ground terminals 80 and the connecting member 851 connecting the two ground terminals 80 are integrally formed by stamping. Each of the ground terminals 80 includes a wide side and a narrow side. The wide side of each ground terminal 80 is arranged in a plane perpendicular to the plane where the wide side of the differential signal terminal pair 710 is located. The middle portion 75 of the signal terminal 70 is bent in the width direction of the ground terminal 80. Its purpose is to achieve the same length of the physical structure of the two signal terminals constituting the signal terminal pair 710, and achieve the same length of the electrical structure to reduce the deviation of signal transmission to less than 0.20 picoseconds (ps). In this embodiment, each terminal module 50 includes two signal terminal pairs 710, and both sides of each signal terminal pair 710 are provided with a pair of ground terminals 80 connected to each other by the connecting member 851. The ground terminals 80 are connected to each other through the connecting member 851 to reduce the crosstalk between adjacent signal terminal pairs 710. The ground terminal 80 is in contact with the absorbing material on the insulating body 60, thereby shielding the signal terminal pair 710 and the adjacent signal terminal pair 710 while absorbing the invalid electromagnetic waves during signal transmission. Thereby reducing the crosstalk and noise generated during signal transmission.

The first electrical connector 1 and the second electrical connector 2 are matched, and the terminal 20 and the corresponding signal terminal 70 are matched with each other to form a signal path. The inner elastic piece 331 of one shielding sheet 30 is in contact with the first ground contact portion 831 of the ground terminal 80 in the corresponding terminal module 50 and the outer elastic piece 335 is in contact with the second ground contact portion 852 in the adjacent terminal module 50.

The ground plate 90 is located on the first side 66 of the insulating body 60. The grounding plate 90 and the connecting member 851 are arranged on the same side of the insulating body 60, and the connecting member 851 is located in front of the ground plate 90 along the mating direction. The insulating body 60 is provided with a groove 665, and the ground plate 90 is provided with a protrusion 95 that matches the groove 665. The ground plate 90 is mechanically and electrically connected to the ground terminal 80 through processes such as assembly, welding or soldering. The distance between the ground terminal 80 and the ground plate 90 in the lateral direction is less than 0.2 mm to reduce signal leakage and reduce signal interference between adjacent signal terminal pairs 710.

The plurality of terminal modules 50 includes a first terminal module 51 and a second terminal module 52 that cooperates with the first terminal module 51. The first terminal module 51 and the second terminal module 52 are combined with each other through positioning holes and positioning posts. Specifically, the inner elastic piece 331 is in contact with the shield of the first terminal module 51, and the outer elastic piece 335 is in contact with the shield of the adjacent second terminal module 52. The mounting end 74 and the mating end 73 of the signal terminal pair 710 in the first terminal module 51 and the second terminal module 52 are arranged in a staggered arrangement to improve the anti-interference ability of signal transmission.

Notably, in the connector 1, the main wall 31 and the pair of side walls 33 of the shielding sheet 30 commonly form a U-shaped structure. Correspondingly, in the connector 2, the pair of first ground contact portions 831 and the second ground contact portion 852 of the ground terminal 80 commonly forms another U-shaped structure opposite to the aforementioned U-shaped structure formed by the shielding sheet 30. Notably, the openings of those two U-shaped structures are opposite toward each other so during mating the combination of those two U-shaped structure essentially defines a frame structure view along the front-to-back direction so as to circumferentially shield both the mating ends 73 of the signal terminal pair 710 and the contact portions 251 of the terminal pair 22 which are mated with each other wherein the shielding sheet 30 includes the inward elastic piece 331 to contact the ground contact portion 831 of the corresponding ground terminal 80, and the outward elastic piece 335 to contact the ground contact portion 852 of the neighboring ground terminal 80.

The above is only one of the embodiments of the present invention, but not all or the only embodiments. Any equivalent changes to the technical solutions of the present invention by those skilled in the art by reading the description of the present invention are covered by the claims of the present invention.

What is claimed is:

1. An electrical connector comprising:

an insulating housing;

a plurality of terminals held on the insulating housing, the terminals are arranged in terminal pairs for transmitting differential signals; and a plurality of shielding sheets held on the insulating housing, each of the shielding sheets including:

at least two walls shielding the terminal pair in at least two directions, and a plurality of elastic pieces extending from the at least two walls in order to cooperate with a mating connector; wherein the elastic pieces of each shielding sheet include an inner elastic piece protruding toward an associated terminal pair and an outer elastic piece protruding away from the associated terminal pair.

2. The electrical connector as claimed in claim 1, wherein each of the shielding sheets includes a main wall and a pair of side walls jointly shielding an associated terminal pair from three directions.

3. The electrical connector as claimed in claim 2, wherein each of the side walls includes one elastic piece, and the main wall includes a pair of spaced elastic pieces.

4. The electrical connector as claimed in claim 3, wherein the elastic piece on the side wall is an inner elastic piece.

5. The electrical connector as claimed in claim 3, wherein all the elastic pieces on the main wall are external elastic pieces.

6. The electrical connector as claimed in claim 3, wherein the pair of terminals forming the terminal pair are narrow-side coupled.

7. The electrical connector as claimed in claim 6, wherein the shielding sheet is directly installed to fix on the insulating housing.

8. An electrical connector assembly comprising:

a first electrical connector; and a second electrical connector mated with the first connector; the second electrical connector comprising:

an insulating housing;

a plurality of terminals held on the insulating housing, the terminals being arranged in terminal pairs for transmitting differential signals, the terminal pairs being arranged in rows and columns; and a plurality of shielding sheets held on the insulating housing, each of the shielding sheets including:

at least two walls shielding the terminal pair in at least two directions, and a plurality of elastic pieces extending from the at least two walls; wherein the elastic pieces of each shielding sheet include an inner elastic piece protruding toward a pair of the terminals forming the terminal pair and an outer elastic piece protruding away from the same pair of terminals.

9. The electrical connector assembly as claimed in claim 8, wherein the first electrical connector includes a plurality of terminal modules arranged in a row direction, each terminal module includes a shielding member, the inner elastic pieces of the shielding sheet of the second electrical connector in one row are in contact with the shielding member of the terminal module, and the external elastic pieces in the one row are in contact with the shielding member of an adjacent terminal module.

10. The electrical connector assembly as claimed in claim 9, wherein the terminal modules include cooperating first terminal modules and second terminal modules, the inner elastic piece is in contact with the shielding member of the first terminal module, and the outer elastic piece is in contact with the shielding member of the second terminal module.

11. An electrical connector assembly comprising:

a header connector including an insulative housing with a plurality of differential-pairs for differential signal transmission, each differential pair being equipped with a metallic shielding sheet which defines a first U-shaped structure; and a receptacle connector including a plurality of terminal modules each including a plurality of terminal pairs for differential signal transmission, each terminal pair being equipped with a ground terminal which defines a second U-shaped structure; during mating, the differential pairs being mated with the corresponding terminal pairs, respectively; wherein the first U-shaped structure and the second U-shaped structure are arranged opposite toward each other to commonly form a frame structure to circumferentially shield the corresponding differential pair and the terminal pair.

12. The electrical connector assembly as claimed in claim 11, wherein the shielding sheet includes an inward elastic piece to inwardly contact the corresponding ground terminal belonging to the same frame structure.

13. The electrical connector assembly as claimed in claim 12, wherein the shielding sheet further includes an outward elastic piece to outwardly contact a neighboring ground terminal belonging to a neighboring frame structure.

14. The electrical connector assembly as claimed in claim 13, wherein the ground terminal includes a pair of transition portions respectively located by two sides of the corresponding terminal pair.

15. The electrical connector assembly as claimed in claim 14, wherein a thickness direction of each of the transition portions is perpendicular to that of the terminal pair.

16. The electrical connector assembly as claimed in claim 15, wherein the inward elastic piece contacts the ground terminal in a direction same with the thickness direction of the transition portion.

17. The electrical connector assembly as claimed in claim 16, wherein the outward elastic piece contacts the ground terminal in a direction same with the thickness direction of each of the terminal pair.

18. The electrical connector assembly as claimed in claim 17, wherein each terminal module is further equipped with a metallic ground plate covering and contacting the corresponding ground terminal.

* * * * *